US008689458B2

(12) United States Patent
Nowack

(10) Patent No.: US 8,689,458 B2
(45) Date of Patent: Apr. 8, 2014

(54) SYSTEM AND METHOD FOR DRYING FIVE-SIDED CONTAINERS

(75) Inventor: William C. Nowack, Miramar Beach, FL (US)

(73) Assignee: Valspar Sourcing, Inc, Minneapolis, MN (US)

( * ) Notice: Subject to any disclaimer, the term of this patent is extended or adjusted under 35 U.S.C. 154(b) by 931 days.

(21) Appl. No.: 12/837,833

(22) Filed: Jul. 16, 2010

(65) Prior Publication Data

US 2012/0015102 A1 Jan. 19, 2012

(51) Int. Cl.
*F26B 3/00* (2006.01)

(52) U.S. Cl.
USPC ..... 34/68; 34/105; 34/218; 432/148; 118/326; 219/388; 427/430.1

(58) Field of Classification Search
USPC ..... 34/381, 439.68, 104, 105, 201, 210, 34/218; 118/300, 326; 219/388, 400; 432/147, 148; 427/421.1, 430.1
See application file for complete search history.

(56) References Cited

U.S. PATENT DOCUMENTS

| | | | | | |
|---|---|---|---|---|---|
| 3,451,094 | A | * | 6/1969 | Espada Kywi | 15/302 |
| 3,757,427 | A | * | 9/1973 | Wilkinson | 34/479 |
| 4,257,172 | A | | 3/1981 | Townsend | |
| 4,771,552 | A | | 9/1988 | Morioka | |
| 4,874,412 | A | * | 10/1989 | Nowack | 55/385.1 |
| 5,397,606 | A | | 3/1995 | Jeffs | |
| 5,456,023 | A | * | 10/1995 | Farnan | 34/270 |
| 6,192,604 | B1 | * | 2/2001 | Morrison | 34/666 |
| 6,393,724 | B1 | * | 5/2002 | Apple et al. | 34/232 |
| 7,045,013 | B2 | | 5/2006 | DeRegge | |
| 7,905,723 | B2 | * | 3/2011 | Klobucar et al. | 432/147 |
| 8,245,414 | B2 | * | 8/2012 | Watson et al. | 34/381 |
| 2002/0114884 | A1 | * | 8/2002 | Friedersdorf et al. | 427/195 |
| 2007/0092657 | A1 | * | 4/2007 | Ferguson et al. | 427/421.1 |
| 2007/0131831 | A1 | * | 6/2007 | Nowack | 248/216.1 |
| 2009/0176031 | A1 | * | 7/2009 | Armellin et al. | 427/492 |
| 2012/0015102 | A1 | * | 1/2012 | Nowack | 427/230 |
| 2013/0014406 | A1 | * | 1/2013 | Weschke et al. | 34/380 |
| 2013/0105473 | A1 | * | 5/2013 | Beaudry et al. | 220/1.5 |

FOREIGN PATENT DOCUMENTS

| | | | | | |
|---|---|---|---|---|---|
| CH | 629686 | A | * | 5/1982 | B05B 15/00 |
| CN | 201138122 | Y | | 10/2008 | |
| DE | 3917004 | A1 | * | 11/1989 | C23C 8/04 |
| JP | 55097497 | A | * | 7/1980 | C25D 13/00 |
| JP | 62066033 | A | * | 3/1987 | F24F 3/147 |
| JP | 2003236437 | B2 | | 8/2003 | |
| JP | 2005083714 | A | | 3/2005 | |
| JP | 2006305409 | A | | 11/2006 | |
| JP | 2008287901 | A | * | 11/2008 | |
| WO | W09615415 | | | 5/1996 | |

OTHER PUBLICATIONS

International Search Report for PCT US2011/044185 filed Jul. 15, 2011.

* cited by examiner

*Primary Examiner* — Steve M Gravini

(57) ABSTRACT

A method of painting a five-sided container, which includes applying a water-based paint to the interior surfaces and the exterior surfaces of the container, and forcing heated air into the open side of the container to at least partially dry the paint on the interior surfaces and the exterior surfaces of the container.

11 Claims, 4 Drawing Sheets

SYSTEM AND METHOD FOR DRYING FIVE-SIDED CONTAINERS

BACKGROUND

FIG. 1 is a schematic illustration of a conventional drying system 10 commonly utilized to dry the paint on five-sided containers with an open side. In the system 10, a source 12 of heated air includes a blower 13 and a heater 15, which supply a large volume of heated air to an arrangement of feed ducts 18, 20. The feed ducts 18, 20 include respective outlet openings 14, 16, through which the heated air is forcefully delivered into a lower region of a drying chamber 30.

Before entering the drying chamber 30, a shipping container is sandblasted, a layer of a primer is applied on the interior and the exterior of all five sides of the sandblasted bare metal surface, and at least one overcoat layer is applied over the primer layer on all the primed surfaces. For example, a solvent-based basecoat and a solvent-based topcoat are typically applied on the primer coat before the container enters the chamber 30.

Referring again to FIG. 1, a painted shipping container 40 enters the chamber 30 and is transported through the chamber 30 on a wheeled carriage 32. As the container 40 moves through the chamber 30, the heated air from the openings 14, 16 moves rapidly upward through the chamber and flows over the inside surfaces 42 and the outside surfaces 44 of the container 40. The rapidly flowing heated air quickly evaporates the solvents in the paint on the surfaces 42, 44 as the air moves upward in the chamber 30 and enters suction openings 22, 24. In the suction openings 22, 24, the heated air is withdrawn from an upper region of the drying chamber 30, where the heated air is vented to the atmosphere or re-enters the air system 12.

SUMMARY

If dried under identical drying conditions, the water in water-based paints does not evaporate as quickly as the solvents in solvent-based paints. If a conventional drying chamber is used to dry shipping containers to which a water-based paint has been applied, the paint on the container does not adequately dry in a reasonable amount of time, which increases operating costs and adversely affects the appearance of the painted container. It is typically not cost-effective to extend the length of the drying chamber or significantly increase the air flow capacity of the system that applies the heated air to the drying chamber.

The present disclosure is directed to a low-cost system and method for drying five-sided containers to which at least one coat of a water-based paint has been applied. The system, which includes a drying chamber and conventional blowers and heaters, may be installed in a shipping facility at low cost, or may be easily retrofitted to existing drying chambers.

In one aspect, the present disclosure is directed to a method of painting a five-sided container, wherein the container includes an open side, a first wall opposite the open side, and four side walls connected to the first wall, wherein the side walls extend in a first direction with respect to the first wall, and wherein each of the first wall and the four side walls have an interior surface and an exterior surface. The method includes applying a water-based paint to the interior surfaces and the exterior surfaces of the first wall and the side walls of the container; and forcing heated air into the open side of the container to at least partially dry the paint on the interior surfaces and the exterior surfaces of the container. The heated air is directed such that the heated air travels in a second direction opposite to the first direction to contact an interior surface of the first wall and flows in a third direction and a fourth direction thereover, wherein the third direction and the fourth direction are substantially opposite one another and substantially normal to the second direction and the first direction. The heated air flows in the first direction along the interior surfaces of the walls of the container; and exits the container.

In another aspect, the present disclosure is directed to a drying system, including a transport apparatus, wherein the transport apparatus is moveable with respect to a floor. A five-sided shipping container is on the transport apparatus, wherein the shipping container includes an open side, a first wall opposite the open side, and four substantially side walls connected to the first wall, wherein each side wall extends in a first direction from the first wall, and wherein each of the bottom wall and the four side walls have an interior surface and an exterior surface; and a source of heated forced air. The system includes at least one air outlet to direct the heated forced air into the open side of the container and at least partially dry the paint on the interior and exterior surfaces of thereof. The air outlet directs the heated air to flow into the open side of the container to contact the interior surface of the bottom wall of the container; flow over the interior surface of the first wall of the container; flow over the side walls of the container; and exit the open side of the container.

In yet another aspect, the present disclosure is directed to a drying system, including a transport apparatus, wherein the transport apparatus is moveable with respect to a floor, and a five-sided shipping container on the transport apparatus. The shipping container includes an open side facing downward toward the floor, a first wall opposite the open side, and four substantially planar side walls connected to the bottom wall, wherein each side wall extends from the first wall and downwardly toward the floor, and wherein each of the bottom wall and the four side walls have an interior surface and an exterior surface. An oven encloses the transport apparatus and the shipping container; and a source deliver heated forced air to the oven. The floor includes an air outlet to direct the heated forced air upwardly and away from the floor to enter the open side of the container and at least partially dry the paint on the interior and exterior surfaces of thereof. The heated air is directed by the outlet to contact the interior surface of the first wall of the container; move over the interior surface of the first wall of the container; move downward toward the floor along the interior surface of the side walls of the container; and exit the open side of the container.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like symbols and reference numerals in the drawings are used to designate like elements.

DETAILED DESCRIPTION

The system and method described in this application may be used to dry a wide variety of shipping containers. For example, in one embodiment the containers may be open-topped containers suitable for overseas transport of goods. These containers are typically transported overseas on a container ship to a port, where they are unloaded from the ship and optionally transported by train and/or truck to their final destination. Such shipping containers are typically about 20 feet long, about 7.5 feet wide, and about 7.5 feet high, with an internal volume of about 1136 $ft^3$, or about 40 feet long, about 7.5 ft wide, and about 7.5 feet high, with an internal volume of 2350 $ft^3$.

Figure 1:
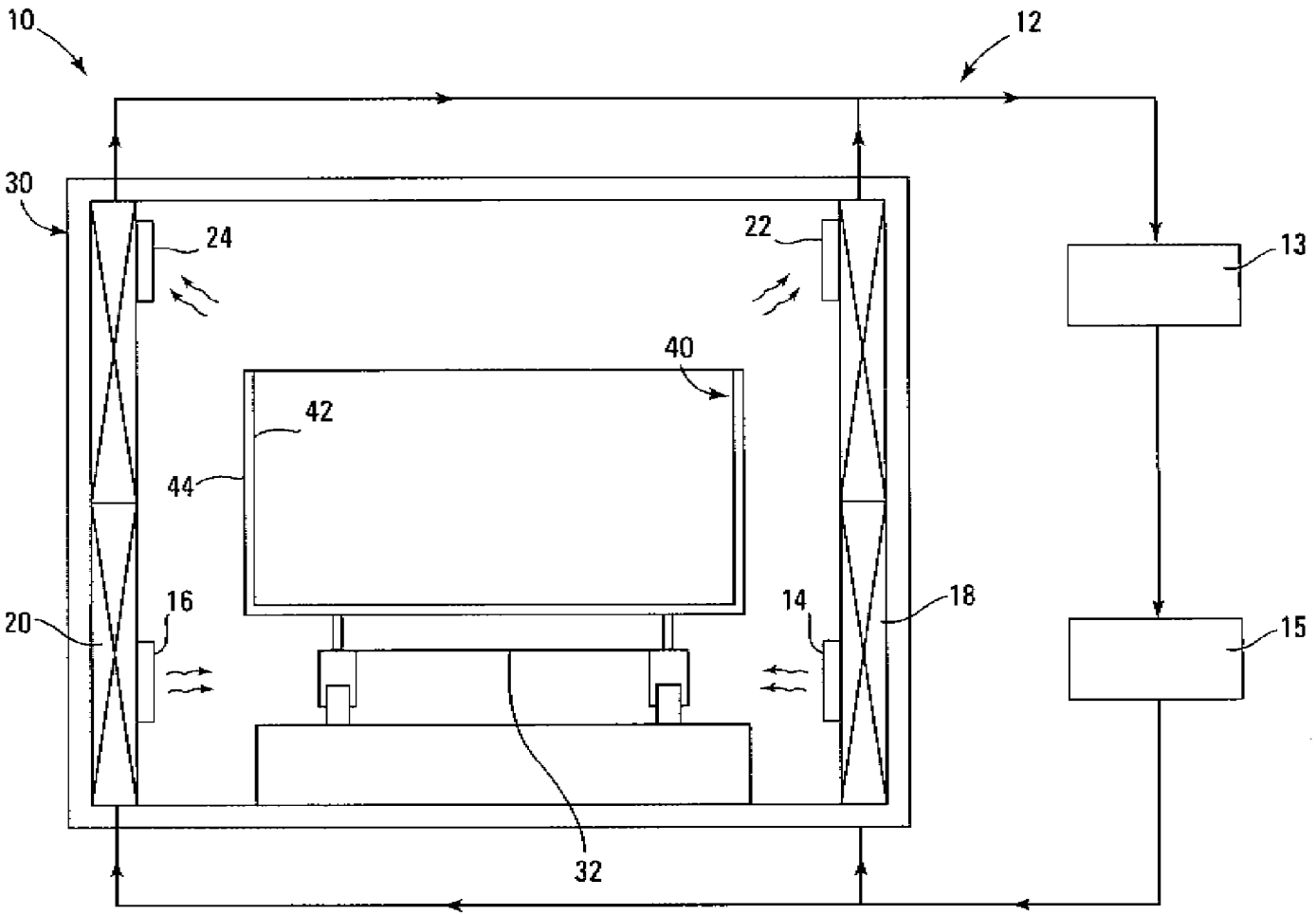
FIG. 1 is a schematic, cross-sectional view of a conventional drying chamber used to dry a five-sided container coated with a solvent-based paint.
Figure 2:
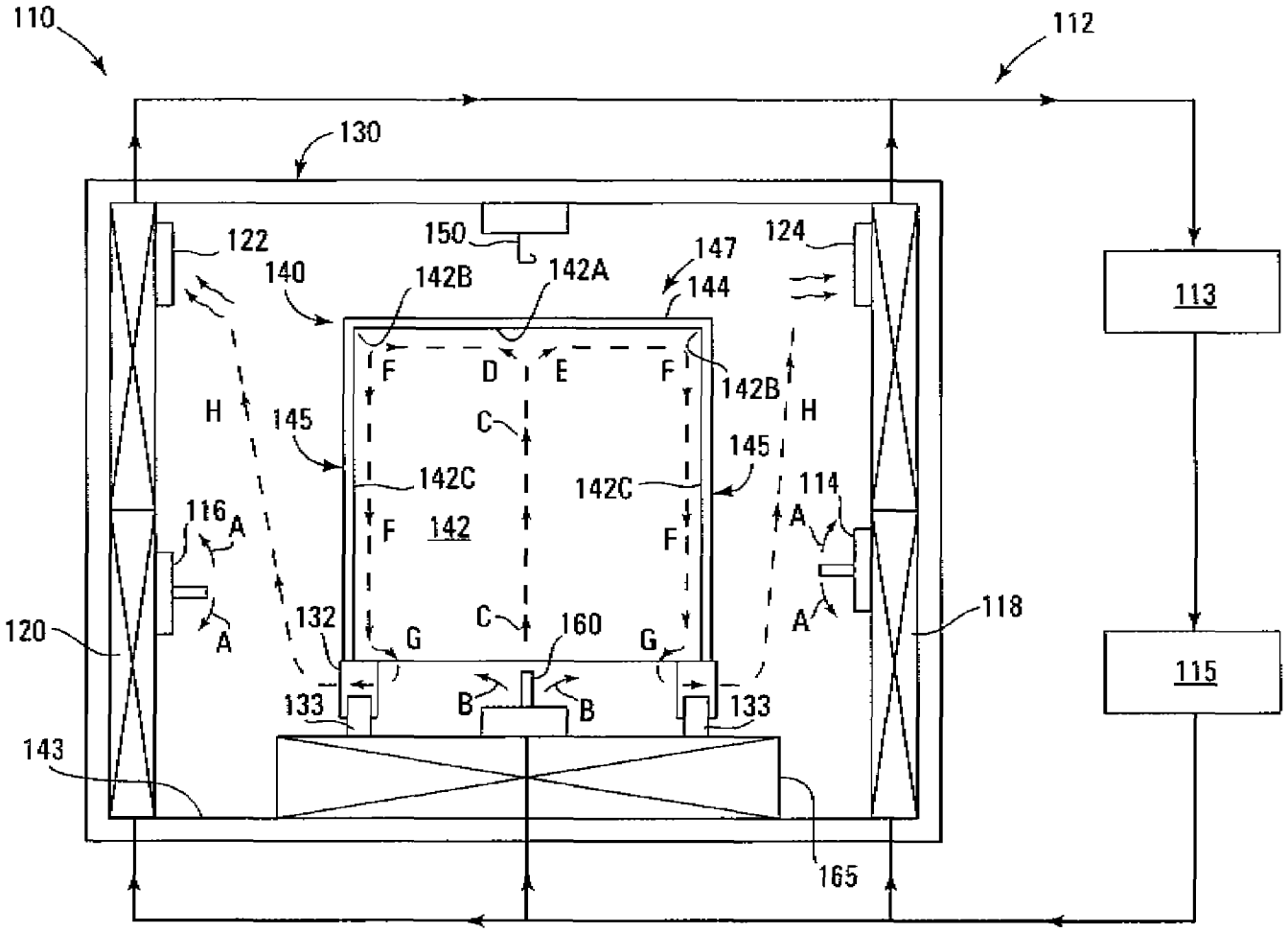
FIG. 2 is a schematic, cross-sectional view of an embodiment of a drying chamber used to dry a five-sided container coated with a water-based paint.

Referring to FIG. 2, a system 110 includes a drying chamber or oven 130. A source 112 of heated air with a blower 113 and a heater 115 supply a large volume of heated air to an arrangement of feed ducts 118, 120 in the oven 130. The drying chamber/oven 130 may be partially or completely closed to the atmosphere, and a partially open configuration is shown in FIG. 2 for ease of description.

Referring again to FIG. 2, the painted container 140 enters the chamber 130 and is transported through the chamber 130 on a wheeled carriage 132. While the wheeled carriage is provides an example, the container 140 may be moved through the chamber 130 by any suitable method, including by placing the container 140 on an arrangement of moveable hooks 150. In the embodiment shown in FIG. 2, the container 140 is placed on the carriage 132 with the open side of the container 132 facing downward toward a floor 143 of the chamber 130. However, the presently claimed system and method are not limited to this arrangement—the open side of the container may be placed in any suitable orientation, depending on the configuration of the ductwork delivering the heated air into the open side of the container. In the embodiment of FIG. 2, the walls 145 of the container 140 are oriented downwardly in a first direction toward the floor 143 of the chamber 130. In this embodiment, a first side 147 of the container 140, which is opposite the open side of the container and substantially normal to the walls 145, is substantially parallel to the floor 143 of the chamber 130.

As the container 140 moves through the chamber 130, heated air is forcefully ejected from outlet openings 114, 116 to provide a flow of air to dry the outer surfaces 144 of the walls 145 and the bottom 147 of the container 140 as the container moves through the chamber 130. The outlet openings 114, 116 may optionally be moveable in the direction of the arrows A to provide more rapid and efficient drying.

In the system 110, heated air is supplied to a feed duct 165 and forcefully ejected from an arrangement of upwardly-facing discharge ducts 160 in the floor 143 of the chamber 130 to provide a flow of air to rapidly evaporate the water in the coatings on the interior surfaces of the container 140. The discharge ducts 160 may include, for example, upwardly-facing tubes or pipes, or slots in the floor 143 of the chamber 130. In the embodiment shown in FIG. 2, the tubes 160 may optionally be moveable (such as, for example, along the direction of the arrows B, and/or in a direction normal to the arrows B) to more efficiently direct the heated air into the interior 142 of the container 140. The discharge ducts 160 are arranged in the floor 143 of the chamber 130 such that the heated air moves rapidly upward into the open side of the container 140 in a second direction along arrows C and substantially opposite to the first orientation direction of the walls 145 of the container 140. The heated air then contacts an interior surface 142A of the first side 147 of the container 140, where it separates and moves along the interior surface 142A in substantially opposite third and fourth directions along arrows D, E to rapidly evaporate the water in the coating applied on the interior surface 142A. As can be seen from FIG. 2, the third and fourth directions D, E are substantially opposite one another and substantially normal to the first and the second directions.

When the heated air flow reaches a corner/edge region 142B of the container 140 where at least one wall 145 and the bottom 147 thereof intersect, the air flow moves over the edge/corner region 142B, turns and moves in the first direction along the arrows F, and flows along the interior surfaces 142C of the walls 145 of the container 140. The rapidly moving air flow evaporates the water in the coating applied to the corner/edges 142B.

After traversing the interior surfaces 142C of the container 140, the air turns along the direction of arrows G and exits the interior 142 of the container 140 via the open side of the container 140. In the embodiment shown in FIG. 2, the air exits between the walls 145 of the container 140 and the carriage 132, or under and/or around the wheels 133 of the carriage 132. After exiting the container 140, the air moves upward in the chamber 130 along the direction of the arrows H and enters suction openings 122, 124. In the suction openings 122, 124, the heated air is withdrawn from an upper region of the drying chamber 130, where the heated air is vented to the atmosphere and/or re-enters the air supply system 112.

Figure 3:
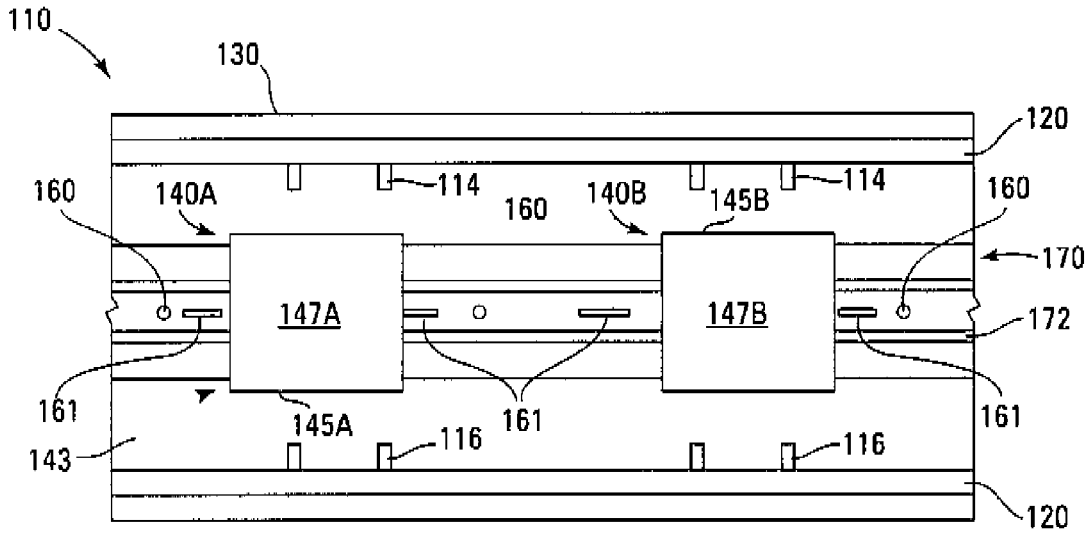
FIG. 3 is a schematic overhead view of the drying chamber of FIG. 2, showing multiple containers moving through the drying chamber.

Referring to FIG. 3, the system 110 may be sufficiently large to dry a plurality of five-sided shipping containers 140A, 140B at the same time. A conveyor system 170 may include tracks 172 to guide the wheeled carriages 132 (not shown in FIG. 3) through the chamber 130. The floor 143 of the chamber 130 includes an arrangement of air discharge ducts (tubes 160 and/or appropriately placed slots 161) to force heated air into the open side of the containers 140. The outlet openings 114, 116 supply heated air to dry the outside surfaces 145A, 145B and 147A, 147B of the containers 140A and 140B.

Figure 4:
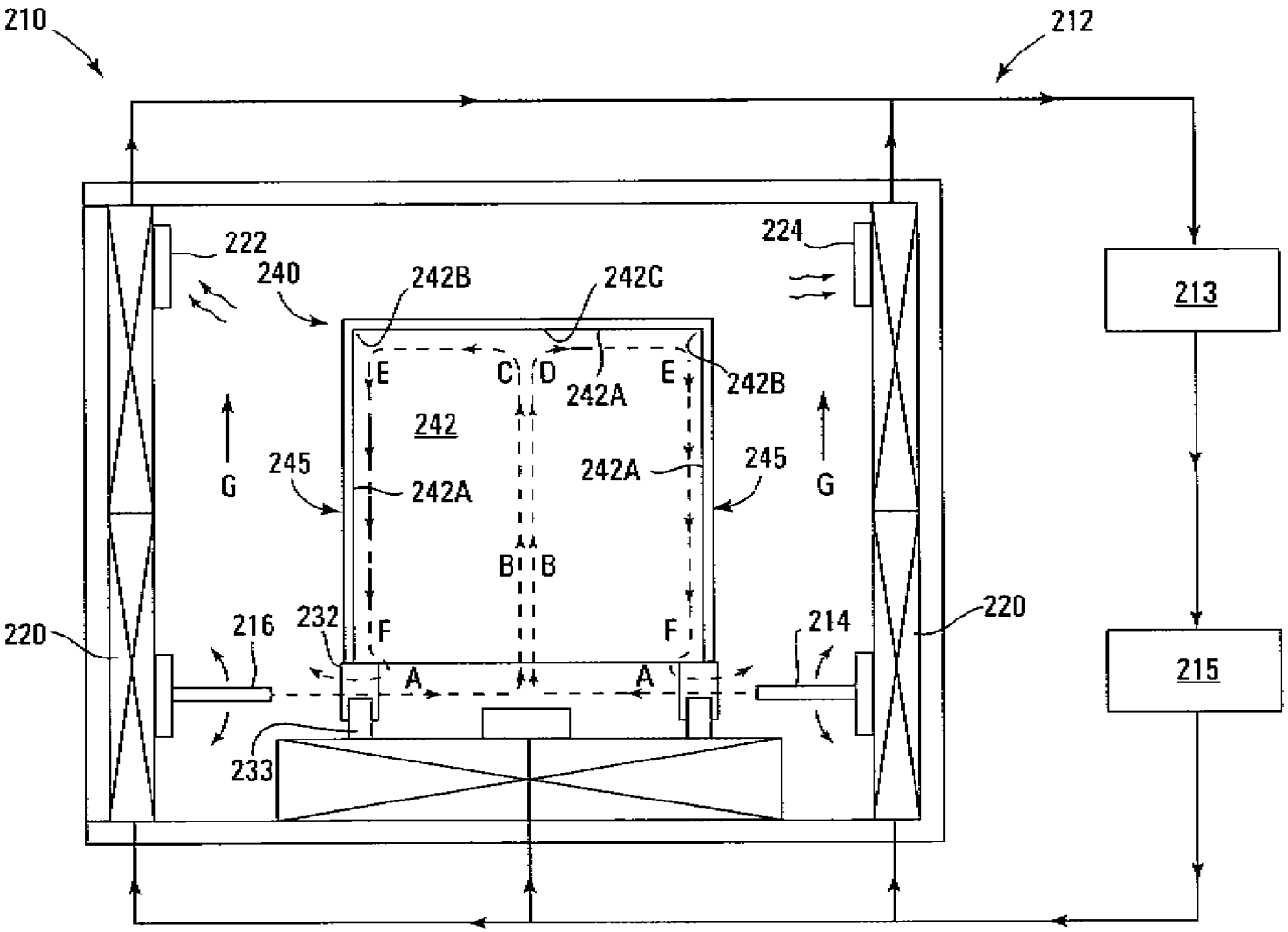
FIG. 4 is a schematic, cross-sectional view of another embodiment of a drying chamber used to dry a five-sided container coated with a water-based paint.

In an alternative embodiment shown in FIG. 4, which may be used alone or in combination with the system shown in FIGS. 2-3, a system 210 includes a drying chamber 230 to which heated air is supplied by an air source 212 including a blower 213 and a heater 215. The air source 212 supplied heated air to the outlet openings 214, 216, which are positioned to direct the heated air generally horizontally and between the moveable carriage 232 and the walls 245 of the five-sided shipping container 240, which in the embodiment of FIG. 4 is turned downwardly toward the floor of the chamber 230. The heated air is forcefully directed along the direction of the arrows A, where it enters the interior 242 of the container 240 via the open side thereof.

Upon entering the interior 242 of the container 240, the heated air streams flowing from the outlet openings 214 and 216 meet and merge to flow vertically upward along the direction of arrows B, which is substantially opposite to the first orientation direction of the walls 245 of the container 240. The heated air then contacts an interior surface 242A of the first side 247 of the container 240, where it separates and moves along the interior surface 242A in substantially opposite third and fourth directions along arrows C, D to rapidly evaporate the water in the coating applied on the interior surface 242A. As can be seen from FIG. 4, the third and fourth directions C, D are substantially opposite one another and substantially normal to the first and the second directions.

When the heated air flow reaches a corner/edge region 242B of the container 240 where at least one wall 245 and the first side 247 intersect, the air flow moves over the edge/corner region 242B, turns and moves in the first direction along the arrows E, and flows along the interior surfaces 242C of the walls 245 of the container 240. The rapidly moving air flow evaporates the water in the coating applied to the corner/edges 242B.

After traversing the interior surfaces 242C of the container 240, the air turns along the direction of arrows F and exits the interior 242 of the container 240 via the open side of the container 240. In the embodiment shown in FIG. 4, the air exits between the walls 245 of the container 240 and the carriage 232, or under and/or around the wheels 233 of the carriage 232. After exiting the container 240, the air moves upward in the chamber 230 along the direction of the arrows G and enters suction openings 222, 224. In the suction openings 222, 224, the heated air is withdrawn from an upper region of the drying chamber 230, where the heated air is vented to the atmosphere and/or re-enters the air supply system 212.

The present disclosure further includes a method for drying a five-sided shipping container using the systems shown in FIGS. 2-4.

When a five-sided container is initially placed in service, or is reconditioned, one or more coats of paint are applied to the container. As part of this painting process any old coats of paint are removed by, for example, sand blasting, bead blasting, dipping in a chemical bath, or a combination thereof. Once the metal surface is fully prepared for painting, at least one coat of paint is applied. Suitable painting steps include applying a primer to the bare metal such as, for example, a zinc-based primer coating. Any number of coatings may be applied over the primer coating, and the applied layers typically include at least one basecoat on the primer coat, and a topcoat on the basecoat. The coatings may be applied by any suitable method, including spraying, dip-coating, and the like. Desirable performance characteristics of the coatings include chemical resistance, abrasion resistance, hardness, gloss, reflectivity, appearance, or combinations of these characteristics.

As noted above, to reduce emission of solvents into the environment, it is desirable for at least the basecoat and the topcoat to be water-based coatings. As used herein the term water-based coating refers to aqueous coatings that include no more than about 10 weight percent (wt %), more preferably, no more than 7 wt %, volatile organic compounds (VOC), based on the total weight of the composition. In addition to low VOC levels, preferred water-based coatings also possess one or more of the following properties: substantially no formaldehyde content, high performance, and low irritation levels.

Once at least one layer of a water-based coating is applied to the five-sided shipping container, it may be placed in the drying chambers of FIGS. 2-4 to at least partially evaporate the water in the coating. The term dried as used herein refers to partially or fully evaporating the water in a coating such that the shipping container can be handled or undergo further preparation and/or painting steps. Since the water in water-based coatings is more difficult to evaporate than the VOCs in solvent-based coatings, processing the shipping container to dry the water-based coating(s) thereon can be time-consuming and expensive. Using the systems of FIGS. 2-4, the drying time for a typical five-sided shipping container can be reduced to no more than about 20 minutes, preferably no more than about 10 minutes, and more preferably no more than about 8 minutes.

For example, to dry the coatings applied on the container 140 of FIG. 2, the parameters such as the size of the container 140, the thickness and the composition of the coatings applied to the container 140, and the temperature and humidity in the ambient air in the chamber 130, may vary widely. To ensure that the container 140 is dried within a reasonable amount of time after it enters the chamber 130, the blower 113 should circulate the heated air within the interior 142 of the container 140 such that the air flows smoothly and rapidly over the interior surfaces 142A, 142B and 142C. Preferably, the blower 113 should supply air at a velocity sufficient to provide smooth and substantially laminar flow over the interior surfaces of the container 140.

For example, in the present method, the systems of FIG. 2 may be used to provide a total drying time of less than about 20 minutes, preferably less than about 8 to less than about 10 minutes, after the container 140 enters the chamber 130. To make such a short drying time possible on such a large object, the blower 113 should provide a sufficient volume of air such that air is discharged in a substantially laminar flow from the arrangement of slots/tubes 160 at a velocity of about 1500 to about 3000 feet per minute (fpm), more preferably at about 2000 to about 2500 fpm. The volume of air discharged into the container should be about 500 to 100 cubic feet per minute (cfm), more preferably about 600 to about 800 cfm. The air volume discharged into the container is typically about 500-1000 cfm per linear foot of container, and a typical 40 foot shipping container would require about 20,000 to about 40,000 cfm.

The internal airflow within the container should be about 0.1 to about 10 meters/second, preferably about 0.3 to about 5 meters/second, and more preferably about 0.4 to about 3 meters/second. Within the container, the heated air has a temperature of about 50 to about 200° C., preferably about 75 to about 125° C.

EXAMPLE

A system similar to that of FIG. 2 utilized two 850 kw fans, each having an upwardly directed nozzle about 39 cm wide and about 8 cm high. The system also utilized 3 diesel heater boxes, each with about 30 horsepower, for a total of about 67 kwh.

The fans each had an average discharge velocity of about 11-12 meters/sec (2100-2300 feet per min), and an average output volume of about 700-800 cfm, which provided an airflow of about 23000 to about 25000 cfm per side for a large 40 foot shipping container.

Air velocity within the interior of the 40 foot shipping container was about 0.3 to about 3.0 meters/second.

The total drying time for a 40 foot shipping container was less than about 20 minutes.

Various embodiments of the invention have been described. These and other embodiments are within the scope of the following claims.

The invention claimed is:

1. A drying system, comprising:

a transport apparatus, wherein the transport apparatus is moveable with respect to a floor, a five-sided shipping container on the transport apparatus, wherein the shipping container comprises an open side, a first wall opposite the open side, and four substantially side walls connected to the first wall, wherein each side wall extends in a first direction from the first wall, and wherein each of the bottom wall and the four side walls have an interior surface and an exterior surface; and a source of heated forced air;

wherein the system comprises at least one air outlet to direct the heated forced air into the open side of the container and at least partially dry the paint on the interior and exterior surfaces of thereof, wherein the air outlet directs the heated air to:

flow into the open side of the container to contact the interior surface of the bottom wall of the container;

flow over the interior surface of the first wall of the container;

flow over the side walls of the container; and exit the open side of the container.

2. The system of claim 1, wherein the air outlet comprises an arrangement of channels to direct the heated forced air into the open side of the container.

3. The system of claim 2, wherein the channels are in the floor.

4. The system of claim 1, wherein the air outlet comprises an arrangement of pipes to direct the heated forced into the open side of the container.

5. The system of claim 4, wherein the pipes project upward from the floor.

6. The system of claim 5, wherein the pipes are substantially normal to a plane of the floor.

7. The system of claim 6, wherein the pipes are moveable in a plane substantially normal to a plane of the floor.

8. The system of claim 1, wherein the transport apparatus is a wheeled dolly, and wherein the dolly comprises a frame to support the container.

9. The system of claim 1, wherein the transport apparatus comprises an arrangement of hooks attached to the container.

10. The system of claim 1, further comprising an oven enclosing the transport apparatus and the shipping container.

11. A drying system, comprising:

a transport apparatus, wherein the transport apparatus is moveable with respect to a floor, a five-sided shipping container on the transport apparatus, wherein the shipping container comprises an open side facing downward toward the floor, a first wall opposite the open side, and four substantially planar side walls connected to the bottom wall, wherein each side wall extends from the first wall and downwardly toward the floor, and wherein each of the bottom wall and the four side walls have an interior surface and an exterior surface;

an oven enclosing the transport apparatus and the shipping container; and a source delivering heated forced air to the oven;

wherein the floor comprises an air outlet to direct the heated forced air upwardly and away from the floor to enter the open side of the container and at least partially dry the paint on the interior and exterior surfaces of thereof, wherein the heated air is directed by outlet to:

contact the interior surface of the first wall of the container;

move over the interior surface of the first wall of the container;

move downward toward the floor along the interior surface of the side walls of the container; and exit the open side of container.

* * * * *